US008415589B2

(12) United States Patent
Morooka et al.

(10) Patent No.: US 8,415,589 B2
(45) Date of Patent: Apr. 9, 2013

(54) HEATING RESISTANCE ELEMENT COMPONENT AND THERMAL PRINTER

(75) Inventors: Toshimitsu Morooka, Chiba (JP); Norimitsu Sanbongi, Chiba (JP); Yoshinori Sato, Chiba (JP); Noriyoshi Shoji, Chiba (JP); Keitaro Koroishi, Chiba (JP)

(73) Assignee: Seiko Instruments Inc. (JP)

( * ) Notice: Subject to any disclaimer, the term of this patent is extended or adjusted under 35 U.S.C. 154(b) by 1054 days.

(21) Appl. No.: 12/286,879

(22) Filed: Oct. 2, 2008

(65) Prior Publication Data

US 2009/0090703 A1 Apr. 9, 2009

(30) Foreign Application Priority Data

Oct. 3, 2007 (JP) ..... 2007-259404

(51) Int. Cl.
*H05B 11/00* (2006.01)
*B41J 2/335* (2006.01)

(52) U.S. Cl.
USPC ..... 219/201; 219/216; 347/205

(58) Field of Classification Search ..... 219/201, 219/216, 538, 541, 543, 546–548; 347/200, 347/204, 205, 207
See application file for complete search history.

(56) References Cited

U.S. PATENT DOCUMENTS 5,285,216 A * 2/1994 Ota et al. ..... 347/223
7,522,178 B2 * 4/2009 Shoji et al. ..... 347/205

* cited by examiner

*Primary Examiner* — Sang Paik
(74) *Attorney, Agent, or Firm* — Adams & Wilks

(57) ABSTRACT

A heating resistance element component has a supporting substrate, an insulating film laminated on the supporting substrate, heating resistors arranged at intervals on the insulating film, a common wire connected to one end of each of the heating resistors, and individual wires each connected to another end of the each of the of heating resistors. A surface of the supporting substrate is formed with a first concave portion and a second concave portion. The first concave portion is arranged in a region opposed to heating portions of the heating resistors. The second concave portion is arranged at an interval in a vicinity of the first concave portion so that heat generated by the heating portions of the plurality of heating resistors is prevented from flowing into the supporting substrate.

20 Claims, 12 Drawing Sheets

EFFICIENCY (RATIO BETWEEN EFFICIENCY OF THERMAL HEAD OF THIS EMBODIMENT AND EFFICIENCY OF THERMAL HEAD WHOSE VOID HEAT INSULATING LAYER HAS 0 μm THICKNESS)

HEATING RESISTANCE ELEMENT COMPONENT AND THERMAL PRINTER

BACKGROUND OF THE INVENTION

1. Field of the Invention

The present invention relates to a heating resistance element component (thermal head) which is used in a thermal printer typically mounted onto a compact information equipment terminal such as a compact handy terminal, and which is used for performing printing on a thermal recording medium through selective driving of a plurality of heating elements based on print data.

2. Description of the Related Art

Recently, thermal printers are widely used in compact information equipment terminals. The compact information equipment terminals are driven by a battery, which leads to strong demands for electric power saving of the thermal printers. Accordingly, there have been growing demands for thermal heads having high heating efficiency.

As to increasing efficiency of the thermal head, there is a method of forming a heat insulating layer as a lower layer of a heating resistor (for example, see JP 2004-34601 A). Among an amount of heat generated in the heating resistor, an amount of upper-transferred heat which is transferred to a wear-resistant layer formed above the heating resistor becomes larger than an amount of lower-transferred heat which is transferred to an insulating substrate under the heating resistor, and thus energy efficiency required during the printing can be sufficiently obtained.

However, in the thermal head disclosed in JP 2004-34601 A, heat generated in a heating element passes through a reinforcement layer, an undercoat, and a heat storage layer at a connecting portion to be diffused to an entire substrate, which leads to a decrease in heating efficiency.

Also in the thermal head disclosed in JP 2004-34601 A, the reinforcement layer which may absorb an external load which acts on an enclosed cavity is provided between the heating element and the enclosed cavity. However, the reinforcement layer has a bending portion, which makes it difficult to provide the reinforcement layer with sufficient strength to absorb the external load.

SUMMARY OF THE INVENTION

The present invention has been made in view of the aforementioned circumstances, and an object thereof is to provide a heating resistance element component capable of increasing heating efficiency of a heating resistor to reduce power consumption and increasing a strength of a substrate under the heating resistor, and to provide a thermal printer utilizing the heating resistance element component.

In order to solve the aforementioned problems, the present invention employs the following means.

The heating resistance element component according to the present invention includes: a supporting substrate; an insulating film laminated on the supporting substrate; a plurality of heating resistors arranged at intervals on the insulating film; a common wire connected to one end of each of the plurality of heating resistors; and individual wires each connected to another end of the each of the plurality of heating resistors. In the heating resistance element component, a surface of the supporting substrate is formed with a first concave portion and a second concave portion, the first concave portion being arranged in a region opposed to heating portions of the plurality of heating resistors, the second concave portion being arranged at an interval in a vicinity of the first concave portion.

According to the heating resistance element component of the present invention, the second concave portion is provided at an interval in the vicinity of the first concave portion formed directly below the heating resistors, whereby heat (amount of heat) generated in the heating resistors can be prevented from flowing into the supporting substrate, and heating efficiency of the heating resistors can be increased. As a result, power consumption can be reduced.

Further, according to the heating resistance element component of the present invention, there is formed a partition wall which functions as a supporting material supporting pressing force applied between the first concave portion and the second concave portion from surfaces of the heating resistors. In other words, even when the pressing force is applied from the surface side of the heating resistors during printing or the like, the partition wall formed between the first concave portion and the second concave portion supports the pressing force, whereby a mechanical strength of the supporting substrate can be increased. As a result, pressure tightness of the substrate can be increased.

In the heating resistance element component, more preferably, the second concave portion is formed on a common wire side and on an individual wire side with respect to the first concave portion along an arrangement direction of the plurality of heating resistors.

According to the aforementioned heating resistance element component, the second concave portion is not formed on both sides (for example, left and right in FIG. 6) of the first concave portion (in other words, the partition wall is provided on the both sides of the first concave portion), and thus the mechanical strength and the pressure tightness of the supporting substrate can be further increased.

In the heating resistance element component, more preferably, the second concave portion is provided in common to the plurality of heating resistors.

According to the aforementioned heating resistance element component, the adjacent second concave portions are made to be in communication with each other, and a part of a flowing path of heat (amount of heat) generated in the heating resistors into the supporting substrate is cut off, whereby the heat (amount of heat) generated in the heating resistors can be further prevented from flowing into the supporting substrate. As a result, heating efficiency of the heating resistors can be further increased, which leads to an additional reduction in power consumption.

In the heating resistance element component, more preferably, the first concave portion is provided in common to the plurality of heating resistors.

According to the aforementioned heating resistance element component, the adjacent first concave portions are made to be in communication with each other, and a part of a flowing path of heat (amount of heat) generated in the heating resistors into the supporting substrate is cut off, whereby the heat (amount of heat) generated in the heating resistors can be further prevented from flowing into the supporting substrate. As a result, the heating efficiency of the heating resistors can be further increased, which leads to an additional reduction in consumption power.

In the heating resistance element component, more preferably, the second concave portion is provided in an annular shape so as to surround a periphery of the first concave portion.

According to the aforementioned heating resistance element component, one or more second concave portions are provided in the annular shape so as to surround the periphery of the first concave portion formed directly below the heating resistors, and thus heat (amount of heat) generated in the heating resistors can be further prevented from flowing into the supporting substrate. As a result, the heating efficiency of the heating resistors can be further increased, which leads to an additional reduction in power consumption.

In the heating resistance element component, more preferably, at least one of the first concave portion and the second concave portion pierces the supporting substrate in a plate thickness direction thereof.

According to the aforementioned heating resistance element component, the first concave portion and the second concave portion are to be made through portions (through holes) which pierce the supporting substrate in the plate thickness direction thereof, and a large part of a flowing path of heat (amount of heat) generated in the heating resistors into the supporting substrate is cut off, whereby the heat (amount of heat) generated in the heating resistors can be further prevented from flowing into the supporting substrate. As a result, heating efficiency of the heating resistors can be further increased, which leads to an additional reduction in power consumption.

The thermal printer according to the present invention includes the heating resistance element component with which the heating efficiency of the heating resistors can be increased to reduce power consumption, and the strength of the supporting substrate under the heating resistors can be increased. Accordingly, printing on thermal paper can be performed with less electric power, whereby the battery life can be extended, and reliability of the entire thermal printer can be increased.

According to the present invention, there can be attained effects of increasing the heating efficiency of the heating resistors to reduce power consumption and of increasing the strength of the substrate under the heating resistors.

DETAILED DESCRIPTION OF THE PREFERRED EMBODIMENTS

Hereinafter, a heating resistance element component according to a first embodiment of the present invention is described with reference to FIG. 1 to FIG. 5.

Figure 1:
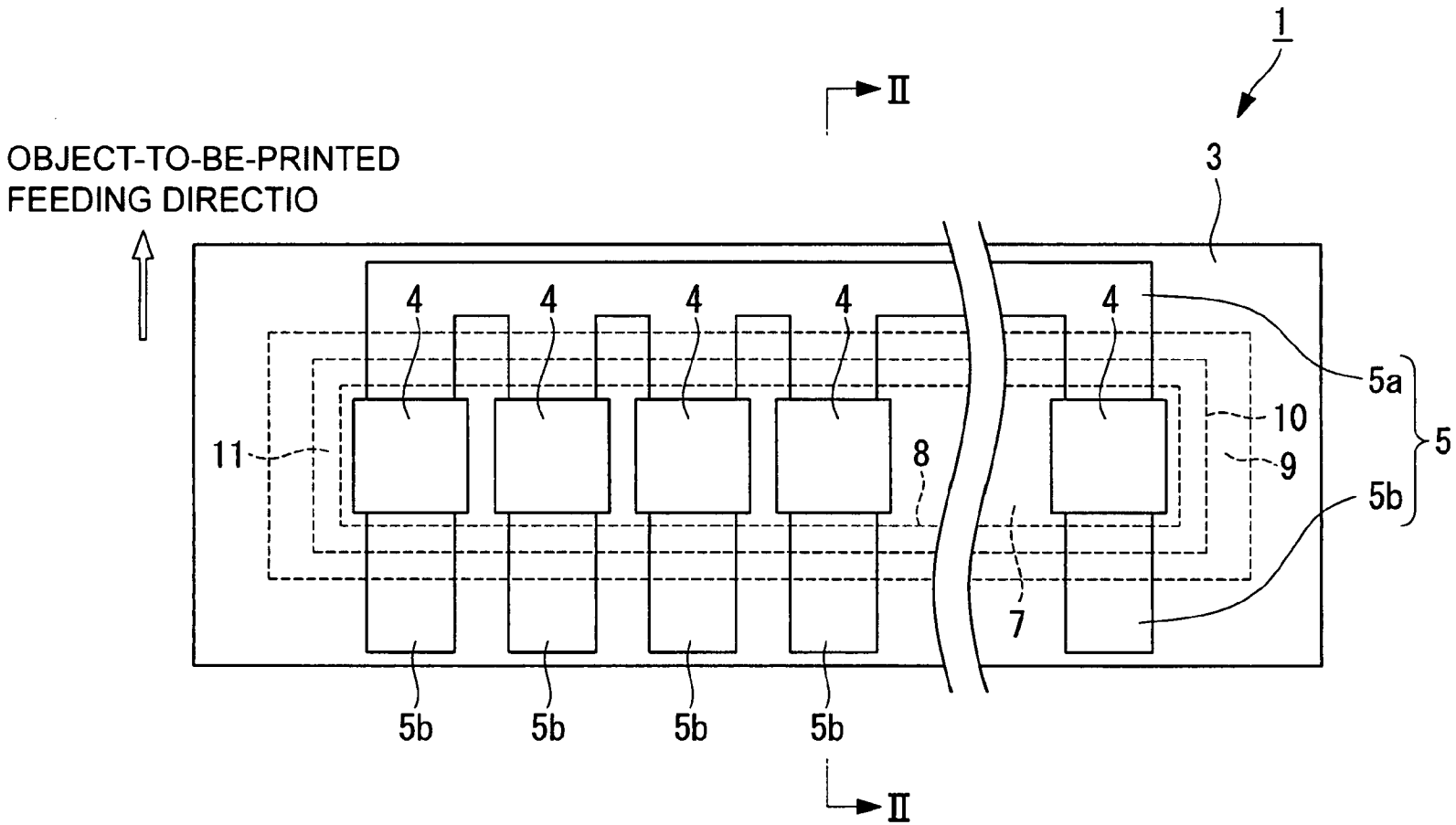
FIG. 1 is a plan view of a thermal head according to a first embodiment of the present invention, which shows a state where a protective film is removed.
Figure 2:
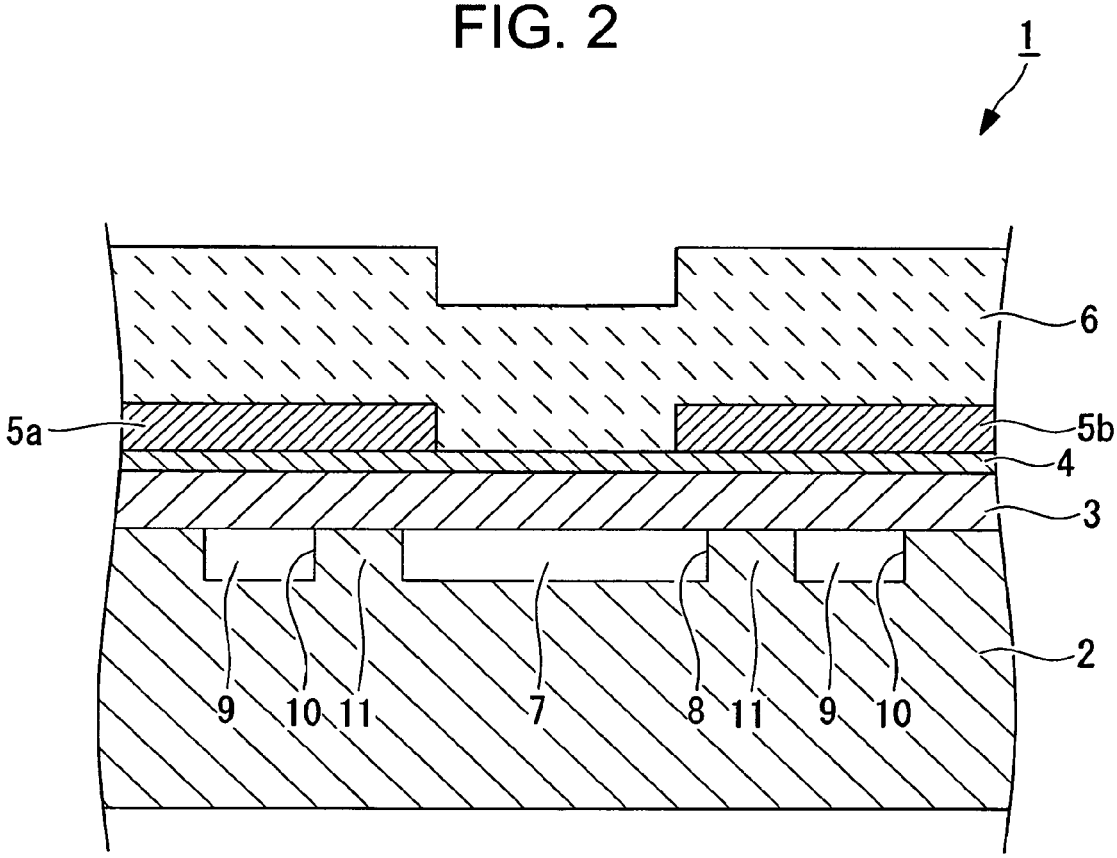
FIG. 2 is a view taken along an arrow II-II of FIG. 1.
Figure 4:
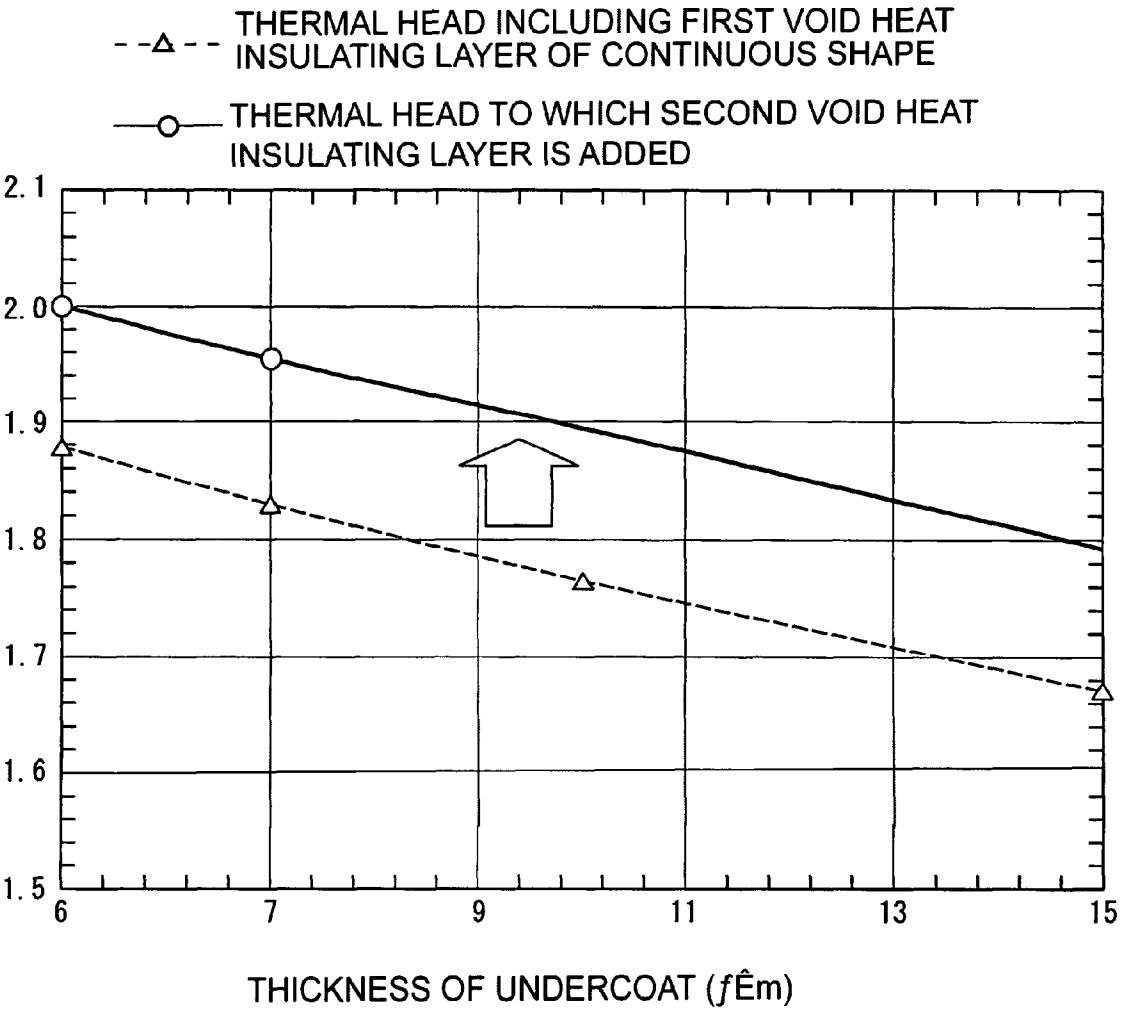
FIG. 4 is a graph showing calculation results of heating efficiency of the thermal head with a thickness of an undercoat being as a parameter.
Figure 5:
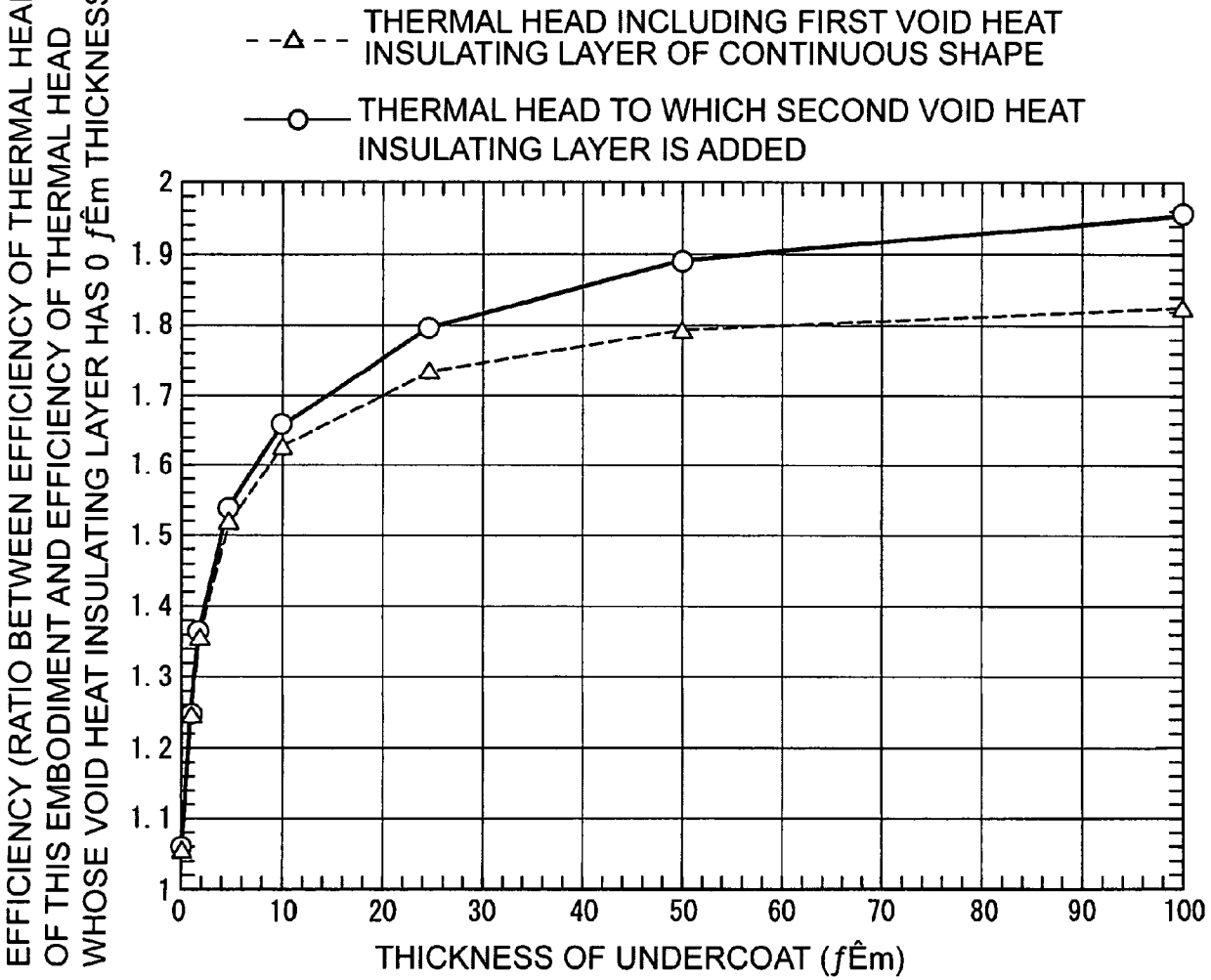
FIG. 5 is a graph showing calculation results of the heating efficiency of the thermal head with a thickness of a first hollow heat insulating layer and a thickness of a second void heat insulating layer being as a parameter.

FIG. 1 is a plan view of a thermal head, which is a heating resistance element component according to this embodiment, and shows a state where a protective film is removed. FIG. 2 is a cross-sectional view taken along an arrow II-II of FIG. 1. FIGS. 3A to 3E are flow charts for describing a method of manufacturing the thermal head which is a heating resistance element component according to this embodiment. FIG. 4 is a graph showing calculation results of heating efficiency of the thermal head with a thickness of an undercoat (insulating film) being used as a parameter. FIG. 5 is a graph showing calculation results of the heating efficiency of the thermal head with a thickness of a first void heat insulating layer and a thickness of a second void heat insulating layer being used as parameters.

A heating resistance element component 1 according to this embodiment is a thermal head used in a thermal printer (hereinafter, referred to as "thermal head").

As shown in FIG. 2, the thermal head 1 includes a supporting substrate (hereinafter, referred to as "substrate") 2 and an undercoat (insulating film) 3 formed on the substrate 2. As shown in FIG. 1 and FIG. 2, a plurality of heating resistors 4 are formed (arranged) at intervals in one direction on the undercoat 3, and wiring 5 is connected to the heating resistors 4. The wiring 5 is formed of a common wire S*a*connected to one end of each of the heating resistors 4 in a direction perpendicular to an arrangement direction thereof (hereinafter, referred to as "object-to-be-printed feeding direction") and individual wires 5*b* connected to another end thereof. Further, as shown in FIG. 2, the thermal head 1 includes a protective film 6 which covers top surfaces of the heating resistors 4 and a top surface of the wiring 5.

It should be noted that a portion (hereinafter, referred to as "heating portion") where the heating resistor 4 actually generates heat is a portion which is not overlapped with the wiring 5.

As shown in FIG. 1 and FIG. 2, on a surface (upper surface in FIG. 2) of the substrate 2, there are formed a first concave portion 8 forming a first hollow portion (first void heat insulating layer) 7 and a second concave portion 10 forming a second hollow portion (second void heat insulating layer) 9.

The first concave portion 8 is a concave portion which is formed such that the first hollow portion 7 is located in a region covered by the heating portions of the heating resistors 4 (in other words, is formed to be communicated with a rear surface (lower surface in FIG. 2) side of the heating portions of the heating resistors 4 and straddle the heating resistors 4 along the arrangement direction of the heating resistors 4) and has a rectangular shape in plan view. A space formed (enclosed) with a bottom surface (surface parallel to a surface of the substrate 2) and wall surfaces (surfaces perpendicular to the surface of the substrate 2) of the first concave portion 8 and a rear surface (lower surface in FIG. 2) of the undercoat 3 forms the first hollow portion 7.

The second concave portion 10 is a concave portion which is formed to surround a periphery of the first hollow portion 7 and has no end, and an outline of wall surfaces (surfaces perpendicular to the surface of the substrate 2) which are formed inside the second concave portion 10 (inwardly) and an outline of wall surfaces (surfaces perpendicular to the surface of the substrate 2) which are formed outside the second concave portion 10 (outwardly) each have a rectangular shape in plan view. A space formed (enclosed) with the bottom surface (surface parallel to the surface of the substrate 2) and the both wall surfaces of the second concave portion 10 and the rear surface (lower surface in FIG. 2) of the undercoat 3 forms the second hollow portion 9.

Through the formation of the first concave portion 8 and the second concave portion 10 on the surface of the substrate 2, a partition wall 11 whose entire surface abuts on the rear surface of the undercoat 3 and which has no end is formed between the first concave portion 8 and the second concave portion 10. In other words, the first concave portion 8 and the second concave portion 10 are sectioned (partitioned) by the partition wall 11.

Heating efficiency can be increased as a width (distance between the first concave portion 8 and the second concave portion 10) of the partition wall 11 becomes smaller (thinner), but, on the contrary, a mechanical strength thereof is decreased. Thus, the width of the partition wall 11 is set to a depth (length in a direction perpendicular to the surface of the substrate 2) of about ⅕ to 2 times (preferably, 0.2 time) a depth (length in a direction perpendicular to the surface of the substrate 2) of the first concave portion 8 and a depth (length in a direction perpendicular to the surface of the substrate 2) of the second concave portion 10. In other words, in the case where the depth of the first concave portion 8 and the depth of the second concave portion 10 are 100 μm, the width of the partition wall 11 is set to about 20 μm to 200 μm (preferably, 20 μm).

It should be noted that the partition wall 11 having the aforementioned width can be formed by processing the first concave portion 8 and the second concave portion 10 using sandblasting, dry etching, wet etching, laser processing, or the like.

On the other hand, the heating efficiency can be increased as a width (distance between the wall surface formed inside the second concave portion 10 and the wall surface formed outside the second concave portion 10) of the second concave portion 10 becomes larger (wider). On the other hand, however, the mechanical strength thereof is decreased. Thus, the width of the second concave portion 10 is set to about a width of ⅓ to 1 time a width (length in an object-to-be-printed feeding direction) of the first concave portion 8. In other words, in the case where the width of the first concave portion 8 is 150 μm, the width of the second concave portion 10 is set to about 50 μm to 150 μm.

Next, a method of manufacturing the thermal head 1 according to this embodiment is described with reference to FIGS. 3A to 3E.

Figure 3D:
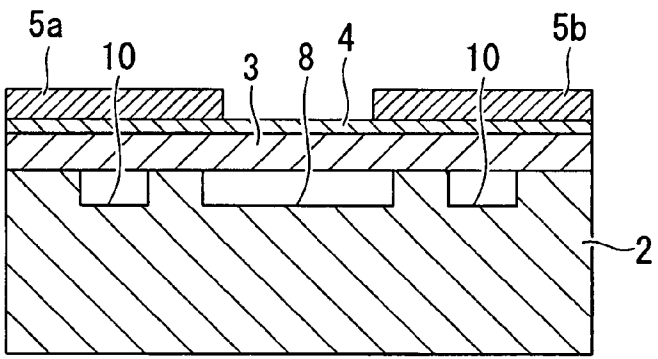
FIGS. 3A to 3E are flow charts for describing a method of manufacturing the thermal head according to the first embodiment of the present invention.
Figure 3E:
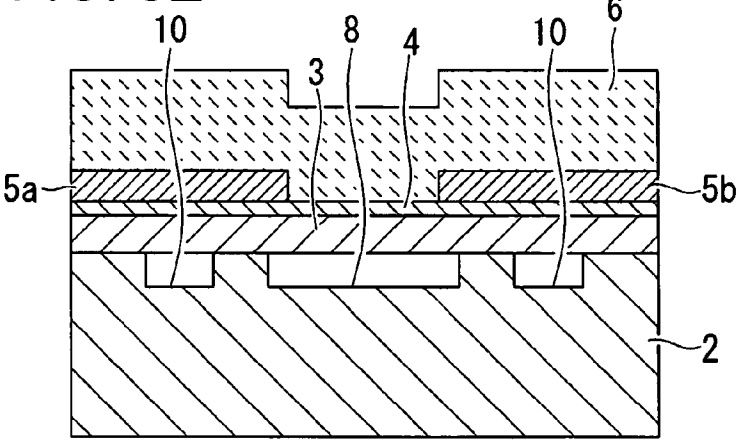
Figure 3A:
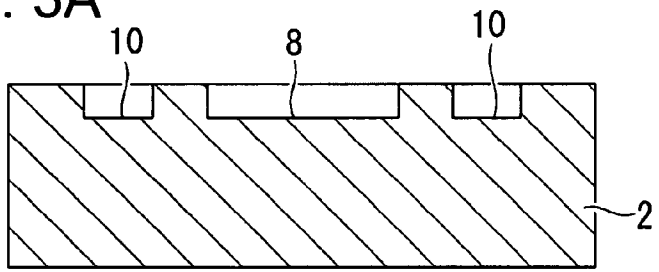

First, as shown in FIG. 3A, in a region on the surface of the substrate 2 having a certain thickness, where the heating resistors 4 are formed, the first concave portion 8 which forms the first hollow portion 7 is processed, and the second concave portion 10 which forms the second hollow portion 9 is processed around the first concave portion 8. As a material of the substrate 2, for example, a glass substrate or a single-crystal silicon substrate is used. A thickness of the substrate 2 is about 300 μm to 1 mm.

The first concave portion 8 and the second concave portion 10 are each formed on the surface of the substrate 2 using sandblasting, dry etching, wet etching, laser processing, or the like.

In the case where the substrate 2 is processed using sandblasting, the surface of the substrate 2 is covered with a photoresist material, and the photoresist material is exposed to light using a photo mask having a predetermined pattern, thereby solidifying a portion other than a region where the first concave portion 8 is formed and a region where the second concave portion 10 is formed. Then, the surface of the substrate 2 is cleaned to remove the photoresist material which is not solidified, whereby an etching mask having an etching window formed in the region where the first concave portion 8 is formed and the region where the second concave portion 10 is formed is obtained. The surface of the substrate 2 is subjected to sandblasting in this state, and thus the first concave portion 8 and the second concave portion 10 which have the predetermined depth are obtained.

In the case where processing is performed through etching, an etching mask having an etching window formed in the region where the first concave portion 8 is formed and the region where the second concave portion 10 is formed is formed on the surface of the substrate 2 in the same manner, and the surface of the substrate 2 is subjected to etching in this state, whereby the first concave portion 8 and the second concave portion 10 which have the predetermined depth are obtained. In the etching process, for example, wet etching is performed using an etching liquid of a tetramethylammonium hydroxide solution, a KOH solution, and a mixed liquid of fluorinated acid and nitric acid or the like in the case of the single-crystal silicon, and wet etching is performed using a fluorinated acid etching liquid or the like in the case of the glass substrate. In addition, dry etching such as reactive ion etching (RIE) and plasma etching is performed.

Figure 3B:
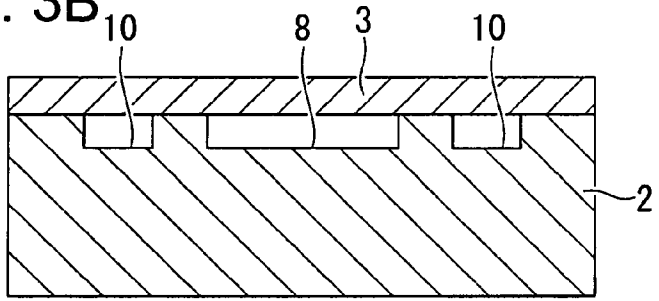
Figure 3C:
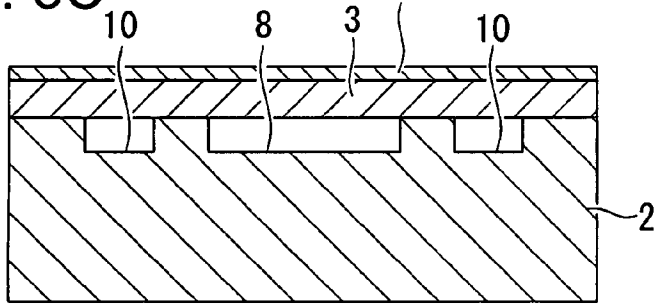

Next, after the etching mask is all removed from the surface of the substrate 2, as shown in FIG. 3B, an insulating material with a thickness of 5 μm to 100 μm is bonded to the surface of the substrate 2, to thereby obtain the undercoat 3 (bonding step). In a state where the undercoat 3 is formed on the surface of the substrate 2 in this manner, the first hollow portion 7 and the second hollow portion 9 are formed between the substrate 2 and the undercoat 3. In this case, the depth of the first concave portion 8 and the depth of the second concave portion 10 are equal to a depth of the first hollow portion 7 and a depth of the second hollow portion 9 (in other words, thickness of the first void heat insulating layer 7 and thickness of the second void heat insulating layer 9), and hence the thicknesses of the heat insulating layers 7 and 9 are easily controlled. As a material of the undercoat 3, for example, glass or a resin is used.

Alternatively, in the case where the undercoat 3 made of thin glass is bonded to the substrate 2 made of glass, bonding is performed using heat fusion in which an adhesive layer is not used. A bonding process of the substrate 2 made of glass and the undercoat 3 made of thin glass is performed at a temperature equal to or higher than an annealing temperature to a temperature equal to or lower than a softening temperature of the substrate 2 made of glass and the undercoat 3 made of thin glass. Therefore, a shape of the substrate 2 and a shape of the undercoat 3 can be maintained with high accuracy, which ensures high reliability.

Here, thin glass having a thickness of about 10 μm is difficult to be manufactured and handled, and is also costly. Thus, in place of bonding the aforementioned thin glass directly to the substrate 2, thin glass having a thickness to be easily manufactured or handled may be bonded to the substrate 2 to be processed so as to have a desired thickness by etching, polishing, or the like. In this case, extremely thin undercoat 3 is formed on one surface of the substrate 2 with ease and at a low cost.

In the etching of thin glass, as described above, various types of etching used in the formation of the first concave portion 8 and the second concave portion 10 can be used. In the polishing of thin glass, for example, chemical mechanical polishing (CMP) which is used in the high-precision polishing for a semiconductor wafer or the like can be used.

Next, the heating resistors 4 (see FIG. 3C), the individual wires 5*b*, the common wire 5*a* (see FIG. 3D), and the protective film 6 (see FIG. 3E) are sequentially formed on the undercoat 3 thus formed. It should be noted that the heating resistors 4, the individual wires 5*b*, and the common wire 5*a* are formed in an appropriate order.

The heating resistors 4, the individual wires 5*b*, the common wire 5*a*, and the protective film 6 can be manufactured using a conventional manufacturing method therefor which is conventionally employed in a thermal head. Specifically, a thin film formation method such as sputtering, chemical vapor deposition (CVD), and vapor deposition is used to form a thin film made of a Ta-based or silicide-based heating resistor material on the insulating film, and the thin film made of the heating resistor material is molded using lift-off, etching, or the like, whereby a heating resistor having a desired shape is formed.

Similarly, on the undercoat 3, a wiring material such as Al, Al—Si, Au, Ag, Cu, and Pt is film-formed using sputtering, vapor deposition, or the like to form the film using lift-off or etching, or the wiring material is screen printed and baked thereafter, to thereby form the individual wires 5*b* and the common wire 5*a* which have the desired shape.

After the formation of the heating resistors 4, the individual wires 5*b*, and the common wire 5*a* as described above, a protective film material such as $SiO_2$, $Ta_2O_5$, SiAlON, $Si_3N_4$, or diamond-like carbon is film-formed on the undercoat 3 using sputtering, ion plating, CVD, or the like to form the protective film 6.

According to the thermal head 1 thus manufactured of this embodiment, the second hollow portion (second void heat insulating layer) 9 is provided to surround the periphery of the first hollow portion (first void heat insulating layer) 7 which is formed directly below the heating resistors 4, and thus the heat (amount of heat) generated in the heating resistors 4 can be prevented from flowing into the substrate 2, whereby the heating efficiency of the heating resistors 4 can be increased. As a result, power consumption can be reduced.

FIG. 4 shows calculation results of efficiency (heating efficiency) of the thermal head with a thickness of the undercoat 3 being as a parameter. In the efficiency of FIG. 4, efficiency of a thermal head, which includes the same heating resistors 4, wiring 5, and protective film 6 as the thermal head 1 according to this embodiment and does not include the first hollow portion 7 and the second hollow portion 9 (in other words, the depth of the first concave portion 8 and the depth of the second concave portion 10 are assumed 0), is assumed 1. A solid line of FIG. 4 shows a relationship between efficiency of the thermal head 1 according to this embodiment and the thickness of the undercoat 3, and a broken line of FIG. 4 shows a relationship between the thickness of the undercoat 3 and efficiency of a thermal head which includes the same heating resistors 4, wiring 5, protective film 6, and first hollow portion 7 as the thermal head 1 according to this embodiment and does not include the second hollow portion 9. As can be seen from FIG. 4, in the thermal head 1 according to this embodiment, when the undercoat 3 has a thickness of 6 μm, the thermal head has efficiency of twice the efficiency of the thermal head which includes the same heating resistors 4, wiring 5, and protective film 6 as the thermal head 1 according to this embodiment and does not include the first follow portion 7 and the second hollow portion 9, and has efficiency of about 1.07 times (2/1.875) the efficiency of the thermal head which includes the same heating resistors 4, wiring 5, protective film 6, and first hollow portion 7 as the thermal head 1 according to this embodiment and does not include the second hollow portion 9.

On the other hand, FIG. 5 shows calculation results of efficiency (heating efficiency) of the thermal head with the depth of the first concave portion 8 and the depth of the second concave portion 10 (in other words, depth of the first hollow portion (first void heat insulating layer) 7 and depth of the second hollow portion (second void heat insulating layer) 9) being as a parameter. In the efficiency of FIG. 5, as in the case of FIG. 4, efficiency of the thermal head, which includes the same heating resistors 4, wiring 5, and protective film 6 as the thermal head 1 according to this embodiment and does not include the first hollow portion 7 and the second hollow portion 9 (in other words, the depth of the first concave portion 8 and the depth of the second concave portion 10 are made 0), is assumed 1. A solid line of FIG. 5 shows a relationship between the efficiency of the thermal head 1 according to this embodiment, and the depth of the first concave portion 8 and the depth of the second concave portion 10, and a broken line of FIG. 5 shows a relationship between the depth of the first concave portion 8 and the efficiency of the thermal head which includes the same heating resistors 4, wiring 5, protective film 6, and first hollow portion 7 as the thermal head 1 according to this embodiment and does not include the second hollow portion 9. As can be seen from FIG. 5, in the thermal head 1 according to this embodiment, when the first concave portion 8 and the second concave portion 10 have a depth of 100 μm, the thermal head has efficiency of 1.96 times the efficiency of the thermal head which includes the same heating resistors 4, wiring 5, and protective film 6 as the thermal head 1 according to this embodiment and does not include the first hollow portion 7 and the second hollow portion 9, and has efficiency of about 1.08 times (1.96/1.82) the efficiency of the thermal head which includes the same heating resistors 4, wiring 5, protective film 6, and first hollow portion 7 as the thermal head 1 according to this embodiment and does not include the second hollow portion 9.

According to the thermal head 1 according to this embodiment, the partition wall 11 which functions as a supporting material supporting pressing force applied from surfaces (upper surfaces in FIG. 2) of the heating resistors 4 is provided between the first concave portion 8 and the second concave portion 10. With the partition wall 11, even when the pressing force is applied from the surface side of the heating resistors 4 during printing or the like, the pressing force is supported by the partition wall 11 left between the first concave portion 8 and the second concave portion 10, whereby the mechanical strength of the substrate 2 is increased. Accordingly, pressure tightness thereof can be increased.

A thermal head according to a second embodiment of the present invention is described with reference to FIG. 6.

Figure 6:
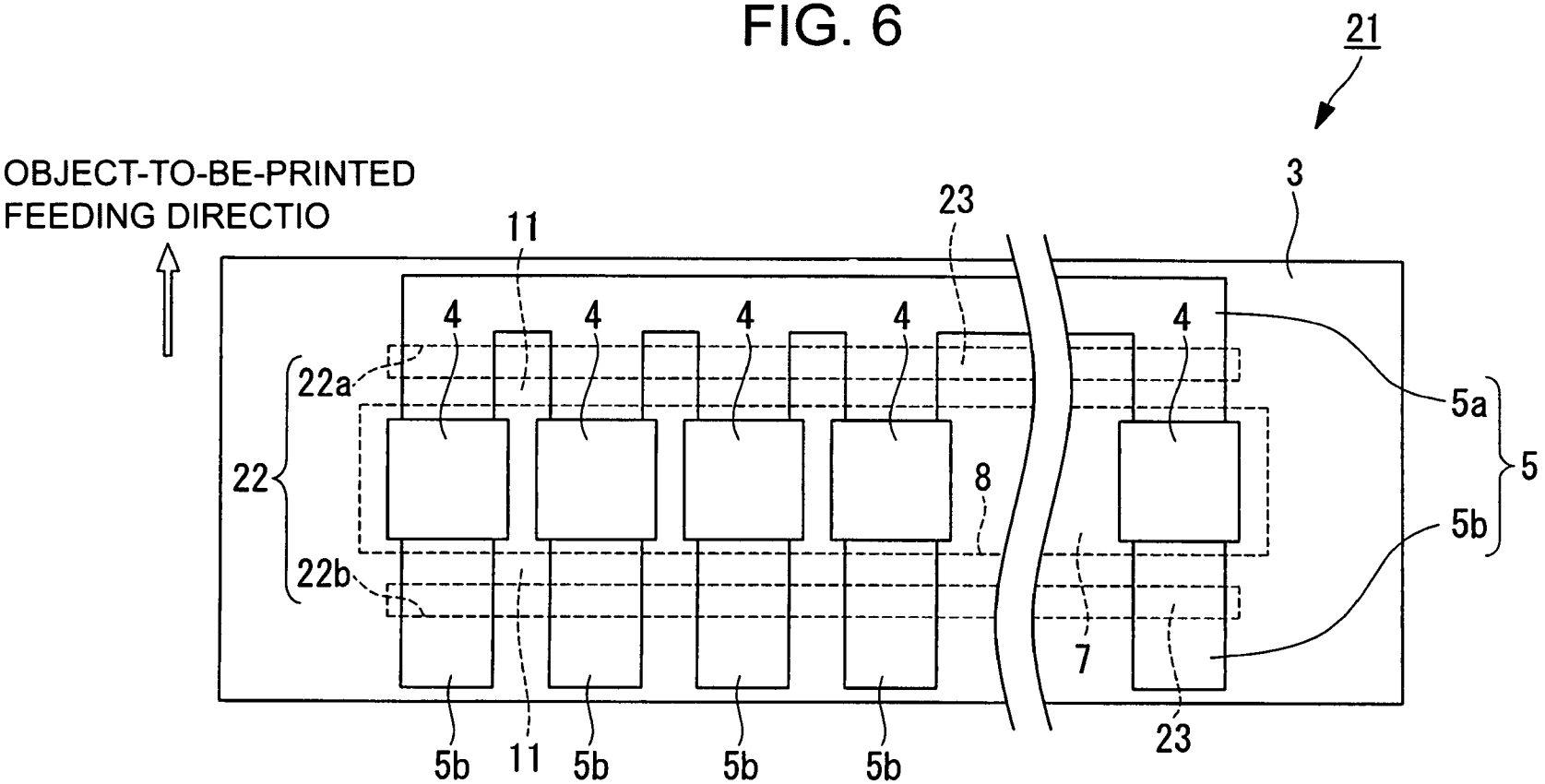
FIG. 6 is a plan view of a thermal head according to a second embodiment of the present invention, which shows a state where the protective film is removed.

FIG. 6 is a plan view of the thermal head according to this embodiment, which shows a state where the protective film is removed.

As shown in FIG. 6, a thermal head 21 according to this embodiment is different from the thermal head 1 described above according to the first embodiment in that a second concave portion 22 is formed in place of the second concave portion 10. Other components of the thermal head 21 are the same as those of the thermal head 1 described above according to the first embodiment, and thus their descriptions are omitted here.

The second concave portion 22 includes a concave portion 22*a* (first concave portion) which extends linearly along the arrangement direction of the heating resistors 4 on the common wire 5*a* side and a concave portion 22*b* (second concave portion) which extends linearly along the arrangement direction of the heating resistors 4 on the individual wire 5*b* side.

The concave portion 22*a* is formed such that one (above in FIG. 6) of second hollow portions (second void heat insulating layers) 23 is located on the surface of the substrate 2, which is covered with the common wire 5*a*, and the concave portion 22*b* is formed such that another (below in FIG. 6) of the second concave portions (second void heat insulating layers) 23 is located on the surface of the substrate 2, which is covered with the individual wires 5. Besides, a space formed (enclosed) with a bottom surface (surface parallel to the surface of the substrate 2) and wall surfaces (surfaces perpendicular to the surface of the substrate 2) of the concave portion 22*a*, and the rear surface of the undercoat 3 forms the one of the second hollow portions 23. A space formed (enclosed) with a bottom surface (surface parallel to the surface of the substrate 2) and wall surfaces (surfaces perpendicular to the surface of the substrate 2) of the concave portion 22*b*, and the rear surface of the undercoat 3 forms the another of the second hollow portions 23.

According to the thermal head 21 of this embodiment, the partition walls 11 are formed on both sides (left and right in FIG. 6) of the first concave portion 8, and thus the mechanical strength and pressure tightness of the substrate 2 can be improved more than the thermal head 1 described above according the first embodiment.

Other operations and effects of this embodiment are the same as those of the first embodiment described above, and thus their descriptions are omitted here.

A thermal head according to a third embodiment of the present invention is described with reference to FIG. 7.

Figure 7:
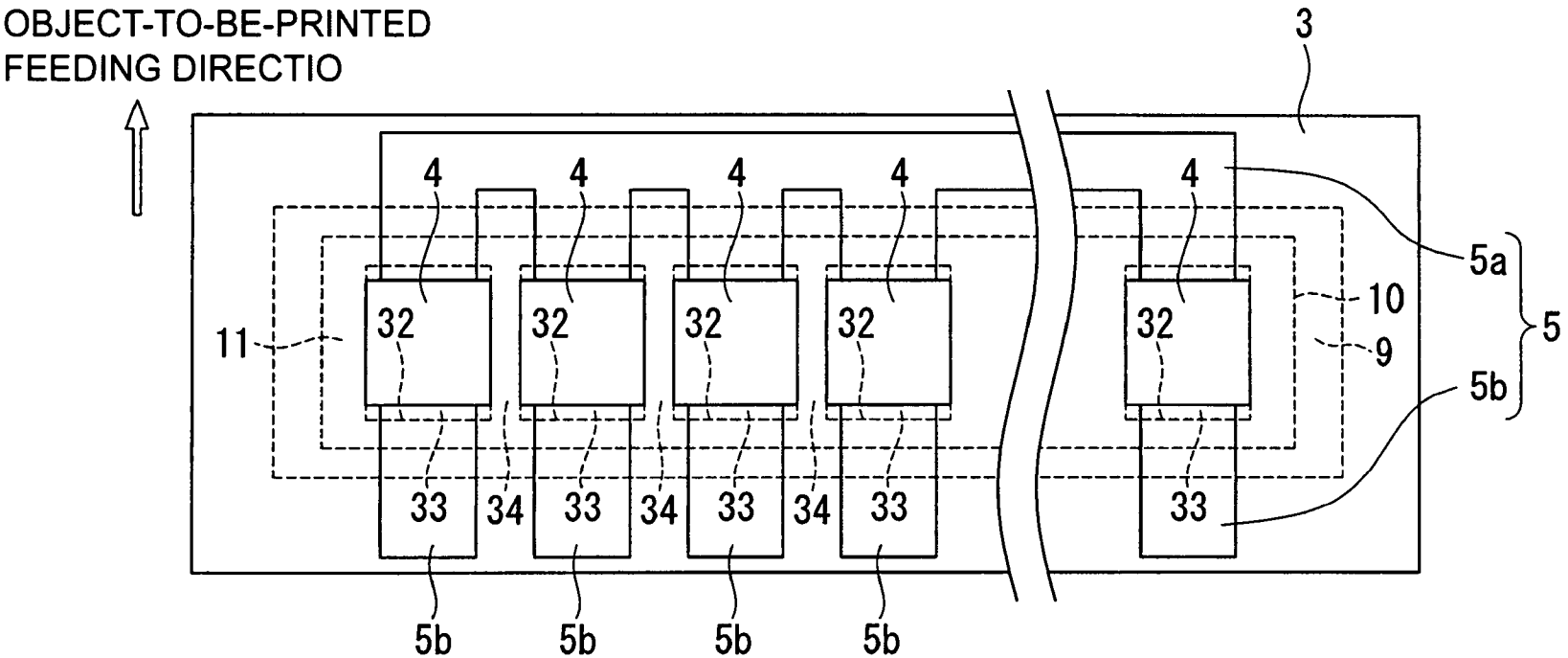
FIG. 7 is a plan view of a thermal head according to a third embodiment of the present invention, which shows a state where the protective film is removed.

FIG. 7 is a plan view of the thermal head according to this embodiment, which shows a state where the protective film is removed.

As shown in FIG. 7, a thermal head 31 according to this embodiment is different from the thermal head 1 described above according to the first embodiment in that first concave portions 32 are formed in place of the first concave portion 8. Other components of the thermal head 31 are the same as those of the thermal head 1 described above according to the first embodiment, and thus their descriptions are omitted here.

The first concave portions 32 are concave portions which are formed along the arrangement direction of the heating resistors 4 such that first hollow portions (first void heat insulating layers) 33 are individually located in respective regions covered by the heating portions of the heating resistors 4 (such that rear surfaces of the heating portions of the heating resistors 4 are not in communicated with each other), and have a rectangular shape in plan view. A space formed (enclosed) with a bottom surface (surface parallel to the surface of the substrate 2) and wall surfaces (surfaces perpendicular to the surface of the substrate 2) of the first concave portion 32, and the rear surface of the undercoat 3 forms the first hollow portion 33.

The first concave portions 32 are formed on the surface of the substrate 2, and thus a partition wall 34 whose entire surface abuts on the rear surface of the undercoat 3 is formed between the adjacent first concave portions 32. In other words, the adjacent first concave portions 32 are sectioned (partitioned) by the partition wall 34.

According to the thermal head 31 of this embodiment, the partition wall 34 is formed between the adjacent first concave portions 32, and thus the mechanical strength and pressure tightness of the substrate 2 can be improved more than the thermal head 1 described above according the first embodiment.

Other operations and effects of this embodiment are the same as those of the first embodiment described above, and thus their descriptions are omitted here.

A thermal head according to a fourth embodiment of the present invention is described with reference to FIG. 8.

Figure 8:
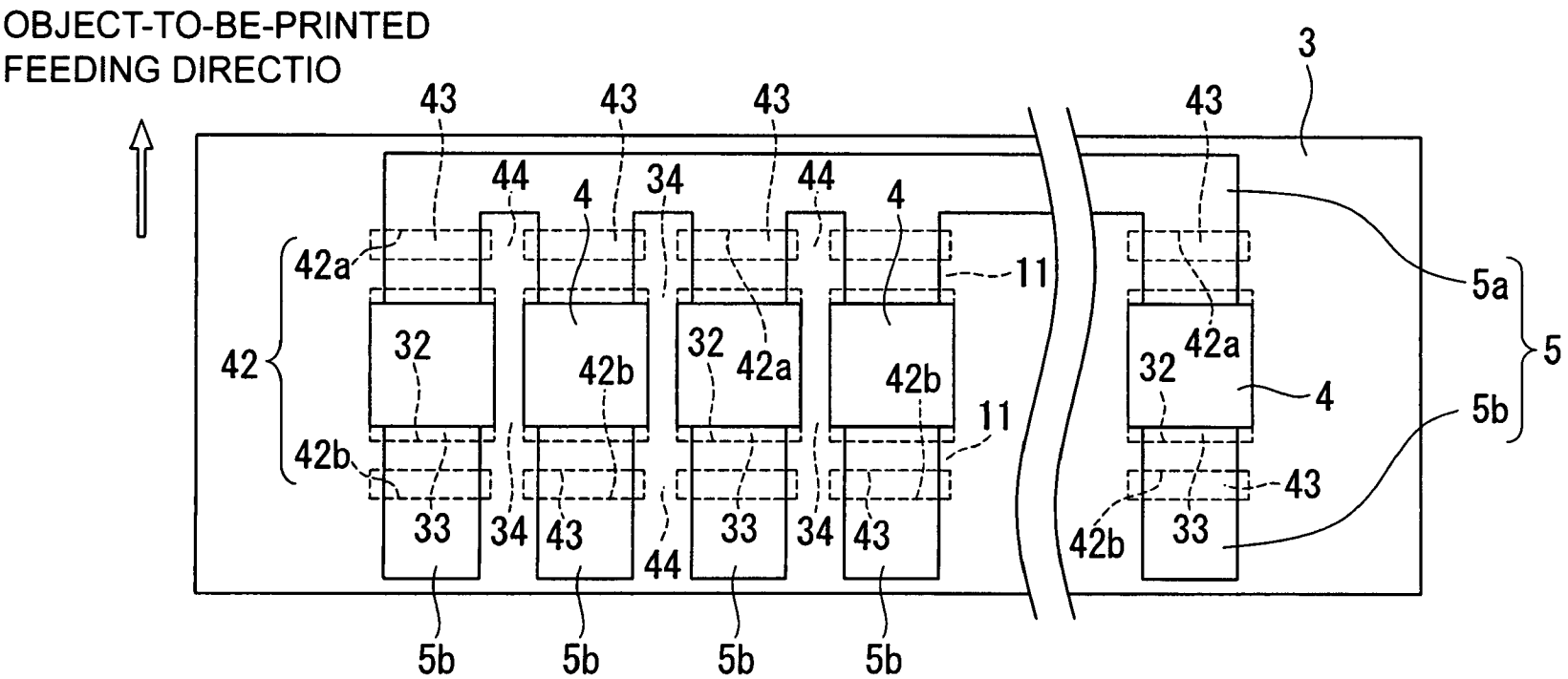
FIG. 8 is a plan view of a thermal head according to a fourth embodiment of the present invention, which shows a state where the protective film is removed.

FIG. 8 is a plan view of the thermal head according to this embodiment, which shows a state where the protective film is removed.

As shown in FIG. 8, a thermal head 41 according to this embodiment is different from the thermal head 31 described above according to the third embodiment in that a second concave portion 42 is formed in place of the second concave portion 9. Other components of the thermal head 41 are the same as those of the thermal head 31 described above according to the third embodiment, and thus their descriptions are omitted here.

The second concave portion 42 includes concave portions 42*a* (first concave portions) which extend linearly along the arrangement direction of the heating resistors 4 on the common wire 5*a* side and concave portions 42*b* (second concave portions) which extend linearly along the arrangement direction of the heating resistors 4 on the individual wire 5*b* side.

The concave portions 42*a* are formed such that ones (upper ones in FIG. 8) of second hollow portions (second void heat insulating layers) 43 are located at intervals (in a broken line shape) on the surface of the substrate 2, which is covered with the common wire 5*a*, and the concave portions 42*b* are formed such that others (lower ones in FIG. 8) of the second hollow portions (second void heat insulating layers) 43 are located at intervals (in a broken line shape) on the surface of the substrate 2, which is covered with the common wires 5*b*. Besides, a space formed (enclosed) with a bottom surface (surface parallel to the surface of the substrate 2) and wall surfaces (surfaces perpendicular to the surface of the substrate 2) of the concave portion 42*a*, and the rear surface of the undercoat 3 forms one of the second hollow portions 43. A space formed (enclosed) with a bottom surface (surface parallel to the surface of the substrate 2) and wall surfaces (surfaces perpendicular to the surface of the substrate 2) of the concave portion 42*b*, and the rear surface of the undercoat 3 forms another of the second hollow portions 43.

The second concave portions 42 (more specifically, adjacent second concave portions 42) are formed at predetermined intervals on the surface of the substrate 2, and thus a partition wall 44 whose entire surface abuts on the rear surface of the undercoat 3 is formed between the adjacent second concave portions 42. In other words, the adjacent second concave portions 42 are sectioned (partitioned) by the partition wall 44.

According to the thermal head 41 of this embodiment, the partition wall 44 is formed between the adjacent second concave portions 42, which increases the mechanical strength and pressure tightness of the substrate 2 more than the thermal head 31 of the third embodiment described above.

Other operations and effects of this embodiment are the same as those of the third embodiment described above, and thus their descriptions are omitted here.

A thermal head according to a fifth embodiment of the present invention is described with reference to FIG. 9 through FIG. 11A to FIG. 11F.

Figure 9:
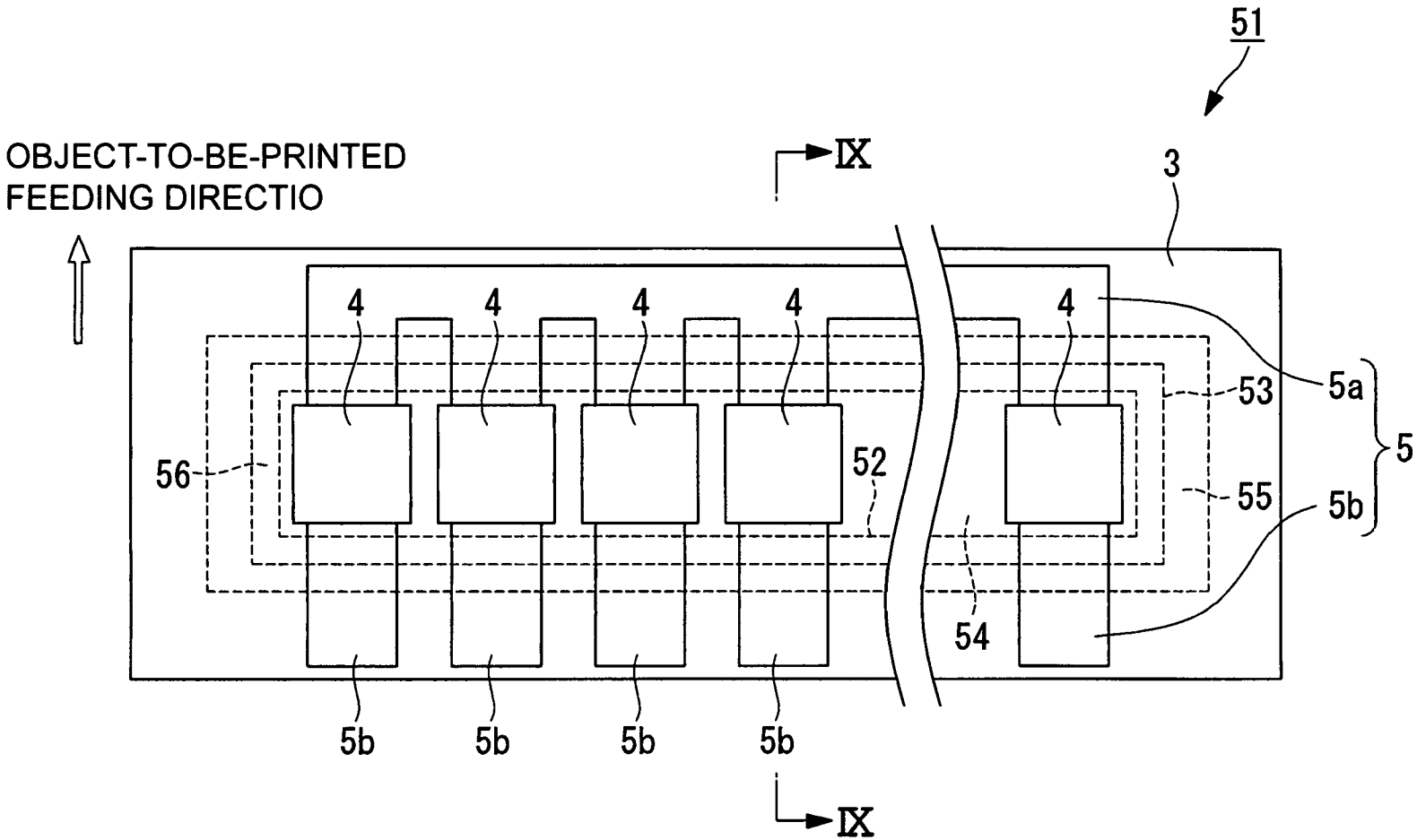
FIG. 9 is a plan view of a thermal head according to a fifth embodiment of the present invention, which shows a state where the protective film is removed.
Figure 10:
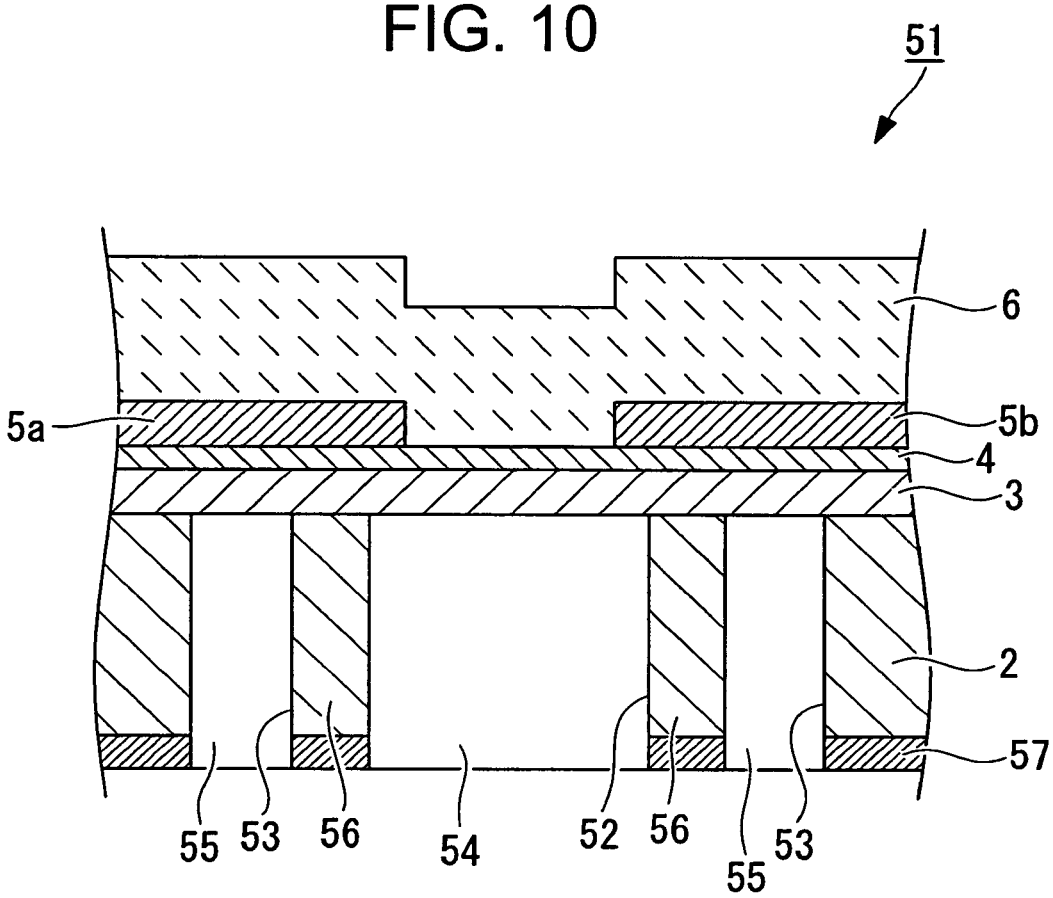
FIG. 10 is a view taken along an arrow IX-IX of FIG. 9.

FIG. 9 is a plan view of the thermal head according to this embodiment, which shows a state where the protective film is removed. FIG. 10 is a view taken along an arrow IX-IX of FIG. 9. FIG. 11A to FIG. 11F are flow charts for describing a method of manufacturing the thermal head according to this embodiment.

As shown in FIG. 9 and FIG. 10, a thermal head 51 according to this embodiment is different from the thermal head 1 according to the first embodiment described above in that a first through portion 52 is provided in place of the first concave portion 8, and in that a second through portion 53 is provided in place of the second concave portion 9. Other components are the same as those of the first embodiment described above, and thus their descriptions are omitted here.

Figure 11A:
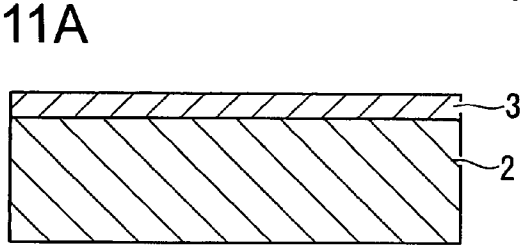
FIGS. 11A to 11F are flow charts for describing a method of manufacturing the thermal head according to the fifth embodiment of the present invention.
Figure 11B:
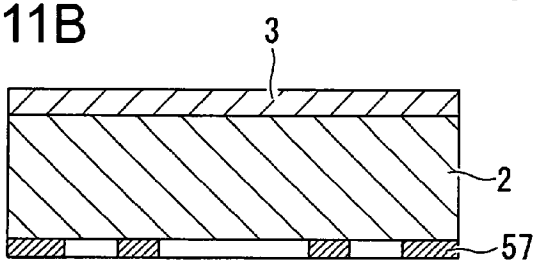
Figure 11C:
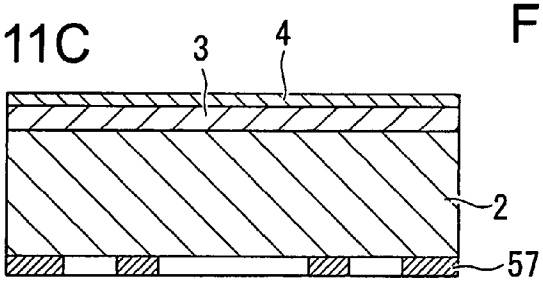
Figure 11D:
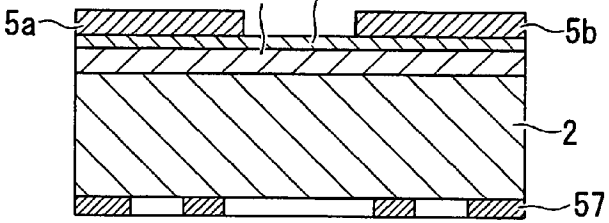
Figure 11E:
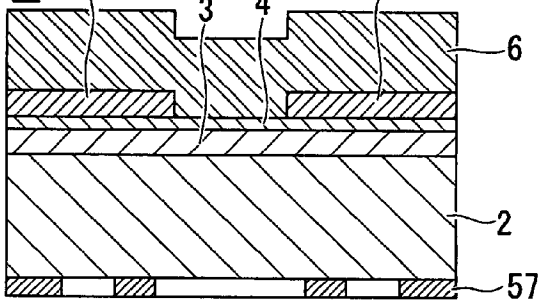
Figure 11F:
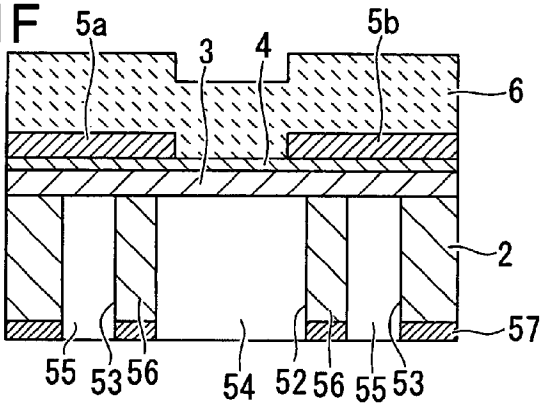

As shown in FIG. 10 and FIG. 11F, the substrate 2 is formed with the first through portion 52 which pierces the substrate 2 in a plate thickness direction thereof and forms a first hollow portion 54, and the second through portion 53 which forms a second hollow portion 55.

The first through portion 52 is a through hole which is formed such that the first hollow portion 54 is located in a region which is covered with the heating portions of the heating resistors 4 (in other words, is formed to be communicated with a rear surface (lower surface in FIG. 10) side of the heating portions of the heating resistors 4 and to straddle the heating resistors 4 along the arrangement direction of the heating resistors 4), and has a rectangular shape in plan view. A space formed with wall surfaces (surfaces perpendicular to the surface of the substrate 2) of the first through portion 52 and the rear surface (lower surface in FIG. 10) of the undercoat 3 forms the first hollow portion 54.

The second through portion 53 is a through hole which is formed to surround a periphery of the first hollow portion 54 and has no end, and an outline of wall surfaces (surfaces perpendicular to the surface of the substrate 2) which are formed inside the second through portion 53 (inwardly) and an outline of wall surfaces (surfaces perpendicular to the surface of the substrate 2) which are formed outside the second through portion 53 (outwardly) each have a rectangular shape in plan view. A space formed with the both wall surfaces of the second through portion 53 and the rear surface (lower surface in FIG. 10) of the undercoat 3 forms a second hollow portion 55.

Through the formation of the undercoat 3 on the surface of the substrate 2, there is formed a partition wall 56 whose entire surface abuts on the rear surface of the undercoat 3 and which has no end between the first through portion 52 and the second through portion 53. In other words, the first through portion 52 and the second through portion 53 are sectioned (partitioned) by the partition wall 56.

It should be noted that reference numeral 57 of FIG. 10 and FIG. 11B to FIG. 11F denotes an etching mask.

Next, a method of manufacturing the thermal head 51 according to this embodiment is described with reference to FIG. 11A to FIG. 11F.

First, as shown in FIG. 11A, the undercoat 3 made of an insulating material is film-formed on the surface of the substrate 2 having a certain thickness. As a material of the undercoat 3, for example, $SiO_2$, SiO, $Al_2O_3$, $Ta_2O_5$, SiAlON, or $Si_3N_4$ is used. As a material of the substrate 2, for example, a glass substrate or a single-crystal silicon substrate is used. The thickness of the substrate 2 is about 300 μm to 1 mm. The thickness of the undercoat 3 is 5 μm to 100 μm.

Next, as shown in FIG. 11B, the etching mask 57 for etching is formed on a surface (rear surface) of the substrate 2, which is opposed to the surface where the undercoat 3 is provided. Specifically, the etching mask 57 made of a mask material is formed by any one of sputtering, vacuum vapor deposition, and CVD. As the mask material, for example, an insulating material such as $SiO_2$ or $Si_3N_4$ is used in the case of a silicon substrate, and a metal material such as Au is used in the case of the glass substrate.

The surface of the etching mask 57 is subjected to patterning using a photoresist (not shown), and then subjected to dry etching such as RIE or wet etching to form the etching mask 57. The etching mask 57 is used to form the first through portion 52 and the second through portion 53 on the substrate 2. Patterning is performed such that an etching window is formed in a region of the surface side where the heating resistors 4 of the surface side are provided and a remaining region thereof is covered.

Next, as shown in FIG. 11C, the heat resistors 4 are formed on the undercoat 3. As a material of the heating resistors 4, for example, a Ta-based or silicide-based heating resistor material is used. The heating resistor material is film-formed by sputtering, vapor deposition, or the like to form the heating resistors 4 by lift-off or etching.

Next, as shown in FIG. 11D, for example, a wiring material such as Al, Al—Si, or Au is film-formed by sputtering, vapor deposition, or the like to form the individual wires 5*b* and the common wire 5*a* by lift-off or etching.

Then, as shown in FIG. 11E, a protective film material such as $SiO_2$, $Ta_2O_5$, SiAlON, or $Si_3N_4$ is film-formed by sputtering, ion plating, CVD, or the like. The protective film 6 is formed to cover entire surfaces of the heating resistors 4 and an entire surface of the wiring 5.

Finally, as shown in FIG. 11F, the substrate 2 is etched by dry etching such as RIE or wet etching from the rear surface side of the substrate 2 with the etching mask 57 formed in FIG. 11B being as a mask, whereby the first through portion 52 and the second through portion 53 which pierce from the rear surface side of the substrate 2 to the rear surface of the undercoat 3.

According to the thermal head 51 thus manufactured of this embodiment, the first through portion 52 and the second through portion 53 are made through holes piercing the substrate 2 in the plate thickness direction thereof. Accordingly, heat (amount of heat) generated in the heating resistors 4 can be prevented from flowing into the substrate 2 more efficiently compared with the thermal head 1 described above according to the first embodiment, and heating efficiency of the heating resistors 4 can be increased more than heating efficiency of the thermal head 1 described above according to the first embodiment, whereby power consumption can be reduced more than power consumption of the thermal head 1 described above according to the first embodiment.

It should be noted that the thermal head according to the present invention is not limited to the thermal heads of the embodiments described above, and can be appropriately modified, changed, and combined as necessary.

For example, the first concave portion 8, 32 can be made a through portion similar to the first through portion 52, and the second concave portion 10, 22, 42 can be made a through portion similar to the second through portion 53.

Further, in the embodiments described above, descriptions are given of a case where the second concave portion 10, 22, 42, and the second through portion 53 are arranged in a single layer outside the first concave portion 8, 32 and the first through portion 52. However, the present invention is not limited thereto, and the second concave portion 10, 22, 42 and the second through portion 53 may be arranged in two layers, or three or more layers.

Figure 12:
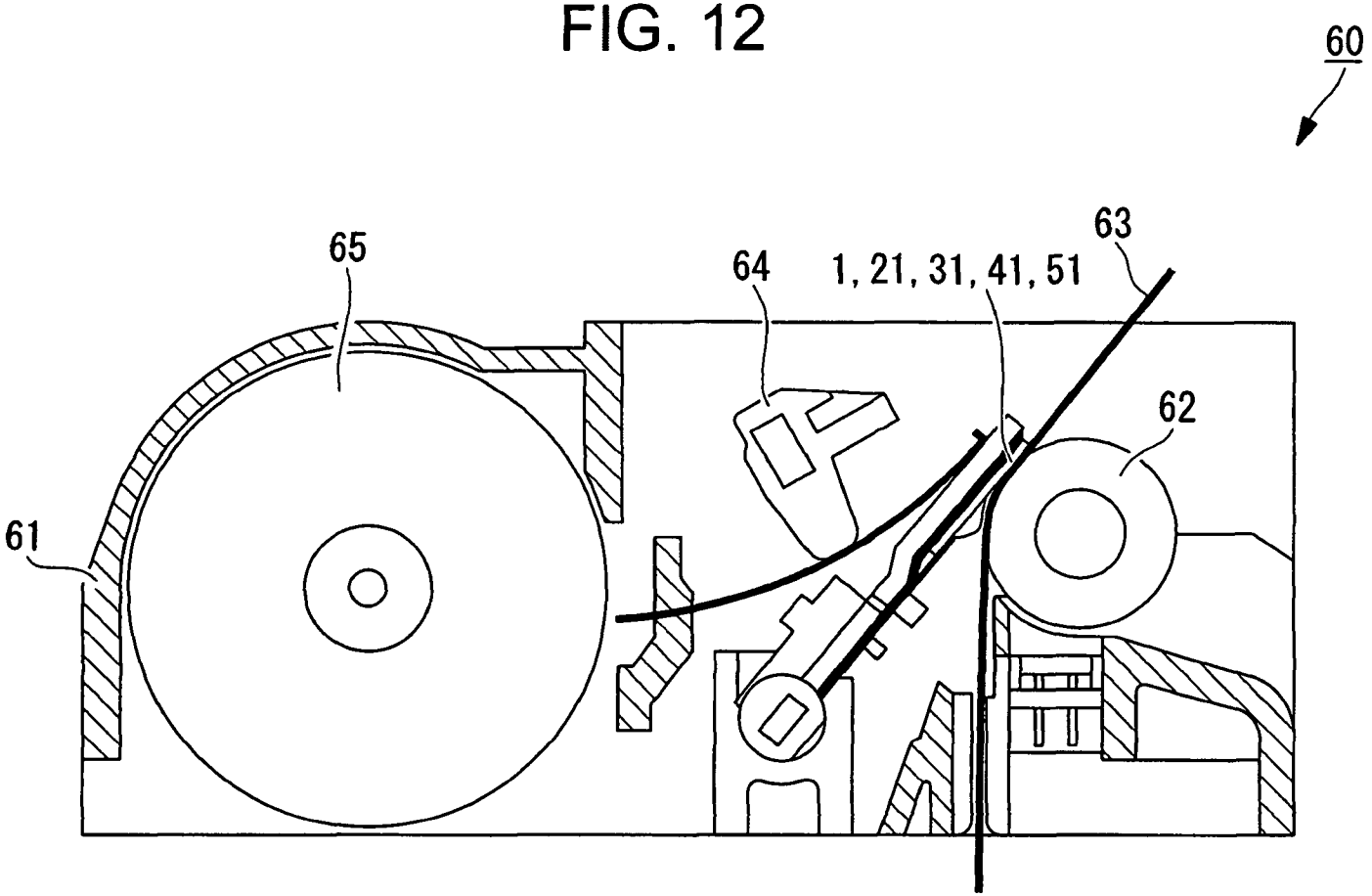
FIG. 12 is a longitudinal sectional view showing a thermal printer according to an embodiment of the present invention.

Next, a thermal printer 60 according to an embodiment of the present invention is described with reference FIG. 12.

The thermal printer 60 according to this embodiment includes a body frame 61 accommodating a platen roller 62 which is horizontally disposed and the thermal head 1, 21, 31, 41, 51 according to the first to fifth embodiments, which is pressed against the platen roller 62 with thermal paper 63 nipped therebetween. The thermal head 1, 21, 31, 41, 51 includes the plurality of heating resistors 4 which are arranged in a longitudinal direction of the platen roller 62, and is pressed into the thermal paper 63 with predetermined pressing force by a pressure mechanism 64. In FIG. 12, reference numeral 65 denotes a sheet-feeding driving motor.

According to the thermal printer 60 of this embodiment, the heating efficiency of the thermal head 1, 21, 31, 41, 51 is high, and thus printing can be performed on the thermal paper 63 with less electric power. As a result, battery life can be extended.

It should be noted that in each of the embodiments, a description is given of the thermal head 1, 21, 31, 41, 51 and the thermal printer 60 which directly performs coloring through heating, but the present invention is not limited thereto. The present invention can be applied to a heating resistance element component other than the thermal head 1, 21, 31, 41, 51 and a printer other than the thermal printer 60.

For example, as the heating resistance element component, the present invention can be applied to a thermal inkjet head which discharges ink using heat, a valve-type inkjet head, or the like. Additionally, the same effects can be obtained in the case of electronic components including other film-like heating resistance element component, for example, a thermal erasure head which substantially has the same structure as a structure of the thermal head 1, 21, 31, 41, 51, a fixing heater such as a printer which requires thermal fixing, or a thin-film heating resistance element for an optical waveguide optical component.

Moreover, regarding the printer, the present invention can be applied to a thermal transfer printer using a sublimation-type or fusing-type transfer ribbon, a rewritable thermal printer capable of coloring and erasing of a printing medium, a thermal active adhesive-type label printer which exhibits adhesion through heating, or the like.

What is claimed is:

1. A heating resistance element component, comprising:
a supporting substrate;
an insulating film laminated on the supporting substrate;
a plurality of heating resistors arranged at intervals on the insulating film;
a common wire connected to one end of each of the plurality of heating resistors; and
individual wires each connected to another end of each of the plurality of heating resistors;
wherein a surface of the supporting substrate is formed with at least one first concave portion and at least one second concave portion, the at least one first concave portion having a width larger than a width of heating portions of the heating resistors and the at least one second concave portion having a width smaller than that of the at least one first concave portion, and the at least one first concave portion being arranged in a region directly under the heating portions of the heating resistors and the at least one second concave portion being arranged at an interval in a vicinity of the at least one first concave portion and not directly under the heating portions of the heating resistors so that heat generated by the heating portions of the plurality of heating resistors is prevented from flowing into the supporting substrate.

2. A heating resistance element component according to claim 1; wherein the at least one second concave portion comprises two second concave portions formed on a common wire side and on an individual wire side, respectively, each of the two second concave portions extending with respect to the at least one first concave portion along an arrangement direction of the plurality of heating resistors.

3. A heating resistance element component according to claim 2; wherein the at least one first concave portion pierces and/or the two second concave portions pierce the supporting substrate in a plate thickness direction thereof.

4. A heating resistance element component according to claim 1; wherein the at least one second concave portion comprises a plurality of second concave portions formed on respective common and individual wire sides in correspondence with the respective plurality of heating resistors.

5. A heating resistance element component according to claim 4; wherein the at least one first concave portion pierces and/or the plurality of second concave portions pierce the supporting substrate in a plate thickness direction thereof.

6. A heating resistance element component according to claim 1; wherein the at least one first concave portion comprises a plurality of first concave portions formed along an arrangement direction of the plurality of heating resistors such that the plurality of first concave portions are located in respective regions of the insulating film covered by the heating portions of the plurality of heating resistors.

7. A heating resistance element component according to claim 6; wherein the plurality of first concave portions pierce and/or the at least one second concave portion pierces the supporting substrate in a plate thickness direction thereof.

8. A heating resistance element component according to claim 1; wherein the at least one first concave portion and/or the at least one second concave portion pierces the supporting substrate in a plate thickness direction thereof.

9. A thermal printer comprising a thermal head having the heating resistance element component according to claim 1.

10. A heating resistance element component comprising: a supporting substrate; an insulating film laminated on the supporting substrate; a plurality of heating resistors arranged at intervals on the insulating film; a common wire connected to one end of each of the plurality of heating resistors; and individual wires each connected to another end of each of the plurality of heating resistors; wherein a surface of the supporting substrate is formed with a first concave portion and a second concave portion, the first concave portion being arranged in a region opposed to heating portions of the plurality of heating resistors, and the second concave portion being arranged at an interval in a vicinity of the first concave portion so that heat generated by the heating portions of the plurality of heating resistors is prevented from flowing into the supporting substrate; and wherein the second concave portion has an annular shape so as to surround a periphery of the first concave portion.

11. A heating resistance element component according to claim 10; wherein at least one of the first concave portion and the second concave portion pierces the supporting substrate in a plate thickness direction thereof.

12. A heating resistance element component, comprising:
a supporting substrate;
an insulating film laminated on the supporting substrate;
a plurality of heating resistors arranged at intervals on the insulating film;
a common wire connected to one end of each of the plurality of heating resistors; and
individual wires each connected to another end of each of the plurality of heating resistors;
wherein a surface of the supporting substrate is formed with a first concave portion and a second concave portion, the first concave portion being arranged in a region opposed to heating portions of the plurality of heating resistors and the second concave portion being arranged at an interval in a vicinity of the first concave portion so that heat generated by the heating portions of the plurality of heating resistors is prevented from flowing into the supporting substrate; and wherein the second concave portion has an annular shape so as to surround a periphery of the first concave portion.

13. A heating resistance element component comprising:

a supporting substrate having at least one first concave portion and at least one second concave portion arranged at an interval from the at least one first concave portion, the at least one second concave portion having a width smaller than that of the at least one first concave portion;

a plurality of heating resistors having heating portions arranged in a region so that the at least one first concave portion, but not the at least one second concave portion, is disposed directly under the heating portions, the width of the at least one first concave portion being larger than a width of the heating portions;

a common wire connected to one end of each of the plurality of heating resistors;

a plurality of individual wires each connected to another end of each of the plurality of heating resistors; and an insulating film laminated on a surface of the supporting substrate and covering each of the at least one first and second concave portions to form first and second the hollow portions, respectively, in a region of the surface of the supporting substrate for inhibiting a heat inflow from the heating portions of the plurality of heating resistors to the supporting substrate.

14. A heating resistance element component according to claim 13; wherein the at least one second concave portion comprises two second concave portions formed on common and individual wire sides, respectively, each of the two second concave portions extending with respect to the at least one first concave portion along an arrangement direction of the plurality of heating resistors.

15. A heating resistance element component according to claim 13; wherein the at least one second concave portion comprises a plurality of second concave portions formed on respective common and individual wire sides in correspondence with the respective plurality of heating resistors.

16. A thermal head having the heating resistance element component according to claim 13.

17. A thermal printer comprising a thermal head according to claim 16.

18. A heating resistance element component comprising:

a supporting substrate having at least one first concave portion and at least one second concave portion arranged at an interval from the at least one first concave portion, the at least one second concave portion having an annular shape so as to surround a periphery of the at least one first concave portion;

a plurality of heating resistors having heating portions arranged in a region opposite to the at least one first concave portion;

a common wire connected to one end of each of the plurality of heating resistors;

a plurality of individual wires each connected to another end of each of the plurality of heating resistors; and an insulating film laminated on a surface of the supporting substrate and covering each of the at least one first and second concave portions to form first and second the hollow portions, respectively, in a region of the surface of the supporting substrate for inhibiting a heat inflow from the heating portions of the plurality of heating resistors to the supporting substrate.

19. A heating resistance element component according to claim 18; wherein the at least one first concave portion comprises a plurality of first concave portions formed along an arrangement direction of the plurality of heating resistors such that the plurality of first concave portions are located in respective regions of the insulating film covered by the heating portions of the plurality of heating resistors.

20. A thermal printer comprising:

heating resistance element component comprising: a supporting substrate having a first concave portion and a second concave portion arranged at an interval from the first concave portion, the second concave portion having an annular shape so as to surround a periphery of the first concave portion; a plurality of heating resistors having heating portions arranged in a region opposite to the first concave portion; a common wire connected to one end of each of the plurality of heating resistors; a plurality of individual wires each connected to another end of each of the plurality of heating resistors; and an insulating film laminated on a surface of the supporting substrate and covering the first and second concave portions to form first and second the hollow portions, respectively, in a region of the surface of the supporting substrate for inhibiting a heat inflow from the heating portions of the plurality of heating resistors to the supporting substrate; and a thermal head having the heating resistance element component.

* * * * *